US011141035B2

(12) United States Patent
Zhang

(10) Patent No.: US 11,141,035 B2
(45) Date of Patent: Oct. 12, 2021

(54) ROLLER MOP CAPABLE OF SELF-CLEANING

(71) Applicant: SHENZHEN NO DOUBT TECHNOLOGY CO., LTD., Guangdong (CN)

(72) Inventor: Yong Zhang, Guangdong (CN)

(73) Assignee: SHENZHEN NO DOUBT TECHNOLOGY CO., LTD., Shenzhen (CN)

( * ) Notice: Subject to any disclaimer, the term of this patent is extended or adjusted under 35 U.S.C. 154(b) by 306 days.

(21) Appl. No.: 16/331,133

(22) PCT Filed: Apr. 18, 2018

(86) PCT No.: PCT/CN2018/083542
§ 371 (c)(1),
(2) Date: Mar. 6, 2019

(87) PCT Pub. No.: WO2018/210093
PCT Pub. Date: Nov. 22, 2018

(65) Prior Publication Data

US 2019/0254495 A1 Aug. 22, 2019

(30) Foreign Application Priority Data

May 19, 2017 (CN) ..... 201710356242.8

(51) Int. Cl.
*A47L 11/40* (2006.01)
*A47L 13/20* (2006.01)
(Continued)

(52) U.S. Cl.
CPC ..... *A47L 11/4013* (2013.01); *A47L 11/24* (2013.01); *A47L 11/28* (2013.01); *A47L 11/40* (2013.01);
(Continued)

(58) Field of Classification Search
CPC ..... A47L 11/28; A47L 11/282; A47L 11/24; A47L 11/40; A47L 11/4013;
(Continued)

(56) References Cited

U.S. PATENT DOCUMENTS 10,022,032 B1 * 7/2018 Li ..... A47L 11/302
10,039,431 B1 * 8/2018 Li ..... A47L 11/4019
(Continued)

FOREIGN PATENT DOCUMENTS

CN 203898208 U 10/2014
CN 204909323 U 12/2015
(Continued)

*Primary Examiner* — Laura C Guidotti
(74) *Attorney, Agent, or Firm* — Conley Rose, P. C.; Grant Rodolph

(57) ABSTRACT

A roller mop capable of self-cleaning, comprising a pull rod (41), a mop head component (1), and a cleaning basin capable of holding the mop head component (1). The pull rod (41) is grasped by a person to operate; a motor (15) in the mop head component (1) drives a roller (10) to clean the ground; after the mopping is ended, the mop head component (1) can be put in the cleaning basin for charging and washing with water. The roller mop provided with a trash bin (17) can receive a number of small trashes; labor intensity is reduced due to the driving of the motor (15); the mop can perform continuous operation, and thus high cleaning efficiency is achieved; moreover, the mop has a self-cleaning effect, and is easy to use.

20 Claims, 9 Drawing Sheets

(51) Int. Cl.

| | |
|---|---|
| ***A47L 11/24*** | (2006.01) |
| ***A47L 11/28*** | (2006.01) |
| ***A47L 13/50*** | (2006.01) |
| ***A47L 11/284*** | (2006.01) |

(52) U.S. Cl.
CPC ..... *A47L 11/4005* (2013.01); *A47L 13/20* (2013.01); *A47L 13/50* (2013.01); *A47L 11/284* (2013.01); *A47L 11/4072* (2013.01); *A47L 11/4088* (2013.01); *A47L 2201/024* (2013.01)

(58) Field of Classification Search
CPC ..... A47L 11/4094; A47L 11/4091; A47L 11/4044; A47L 11/4041; A47L 11/4036; A47L 11/4027; A47L 11/4016; A47L 11/4005; A47L 2201/024; A47L 13/50; A47L 13/58
See application file for complete search history.

(56) References Cited

U.S. PATENT DOCUMENTS

| | | | | |
|---|---|---|---|---|
| 10,136,781 | B2 * | 11/2018 | Li | A47L 11/4041 |
| 2012/0137464 | A1 | 6/2012 | Thatcher et al. | |
| 2016/0353963 | A1 | 12/2016 | Kellis et al. | |
| 2017/0231457 | A1 * | 8/2017 | Cloud | B01D 21/2488 210/195.1 |
| 2020/0107693 | A1 * | 4/2020 | Zhang | A47L 11/4027 |
| 2020/0406306 | A1 * | 12/2020 | Liu | A47L 11/4002 |

FOREIGN PATENT DOCUMENTS

| | | | | |
|---|---|---|---|---|
| CN | 205181256 | U | 4/2016 | |
| CN | 107007213 | A | 8/2017 | |
| WO | WO 2015/090154 | A1 * | 6/2015 | A47L 13/58 |

* cited by examiner

ROLLER MOP CAPABLE OF SELF-CLEANING

FIELD OF THE INVENTION

The invention relates to the mop device, and in particular, to a roller mop capable of self-cleaning.

BACKGROUND

The mop is an important cleaning tool. When the prior mop is used to clean the ground, the labor intensity thereof is high and the cleaning ability is limited, which cannot receive a number of small trashes, and the purpose of cleaning can be achieved by repeated mopping. At the same time, most of the prior mops do not have the function of self-cleaning. Therefore, there is an urgent demand to design a mop with high cleaning efficiency, capable of receiving a number of small trashes with self-cleaning function.

SUMMARY OF THE INVENTION

The invention is to solve the technical issues in the prior mops that the labor intensity is high, the cleaning efficiency is not high, a number of small trashes cannot be received, and the self-cleaning function is not provided, and to provide a roller mop capable of self-cleaning.

To solve the technical issues set forth, the invention provides a roller mop capable of self-cleaning, comprising a pull rod, a mop head component, and a cleaning basin capable of holding the mop head component; the pull rod is grasped by a person to operate, and is provided with a control circuit therein, and a battery, a power-on button, a self-cleaning button, a signal contact piece and a charging contact piece that are electrically connected to the control circuit; the outside of the pull rod is provided with a hook; the mop head component comprises a shell, and the rear end of the shell is hinged to the bottom of the pull rod; the inside of the shell is provided with a motor controlled by the control circuit; the motor drives a roller at the outside thereof, and the lower part of the roller is exposed from the front of the shell to clean the ground; the position near the roller inside the shell is provided with a trash bin; the cleaning basin comprises a basin body, and the inside of the basin body is provided with a cleaning chamber and an outlet chamber stacked on top of each other; the cleaning chamber is open upward for holding the mop head component to be cleaned, and the cleaning chamber is connected to the external tap water through an inlet solenoid valve; the outlet chamber is connected to the external sewage pipe through a drain solenoid valve; between the cleaning chamber and the outlet chamber is provided with a netted trash bag; a support column for supporting the pull rod is erected at one side of the basin body, and the support column is provided with a socket for inserting the hook of the pull rod, a signal elastic piece, and a charging elastic piece; the inlet solenoid valve and the drain solenoid valve are connected to the control circuit through the signal contact piece and the signal elastic piece; after passing through the power adapter, the mains is connected to the control circuit through the charging contact piece and the charging elastic piece.

The shell comprises an upper cover and a chassis that can be fastened up and down; the rear end of the chassis is hinged to the bottom of the pull rod through a rotating rod, and the rear end of the chassis is provided with wheels.

The front end of the trash bin is installed with a scraping soft film at the position close to the roller and the ground, and the a cleaning strip for cleaning the surface of the roller is fixed at the middle of the upper cover; the bottom of the trash bin is provided with an upward-open flap door and at least one upward-protrude hollow flushing sleeve.

The front end of the upper cover is hinged to the front end of the chassis, and the rear end of the upper cover is engaged with the middle of the chassis through a spring handle.

The top end of the pull rod is provided with a handle bent in the direction of the mop head component, and the power-on button and the self-cleaning button are disposed on the handle.

Between the middle of the chassis and the bottom end of the pull rod is provided with a spring; the pull rod is moved by the spring to the top of the mop head component when it is not subjected to an external force, so that the roller mop maintains an upright status; the pull rod adopts the telescopic rod.

The battery adopts the elongated structure and is fastened to the outer side wall of the bottom of the pull rod; the cleaning strip adopts the brush or the soft rubber strip, and the roller adopts the polymer foam.

The side wall of the cleaning chamber is provided with a water level sensor connected to the control circuit, and when the water level sensor senses that the water is in place, the control circuit closes the inlet solenoid valve.

One side of the basin body is provided with an overflow chamber; the side wall of the cleaning chamber is provided with an overflow port connecting the overflow chamber, and the overflow chamber is connected to the external sewage pipe.

One side of the bottom board of the cleaning chamber sinks downward, and the netted trash bag is provided therein; the bottom board of the cleaning chamber is inclined downward toward the side of the netted trash bag; the middle of the bottom board is provided with a water-flowing groove, and a top piece is erected in the water-flowing groove; at least one flushing pipe that can be inserted into the flushing sleeve is erected at the bottom of the cleaning chamber, and the inlet end of the flushing pipe is connected to the inlet solenoid valve.

Compared with the prior art, the invention provided with a trash bin can receive a number of small trashes; labor intensity is reduced due to the driving of the motor; the mop can perform continuous operation, and thus high cleaning efficiency is achieved; moreover, the mop has a self-cleaning effect, and is easy to use.

DETAILED DESCRIPTION OF THE PREFERRED EMBODIMENTS

Figure 1:
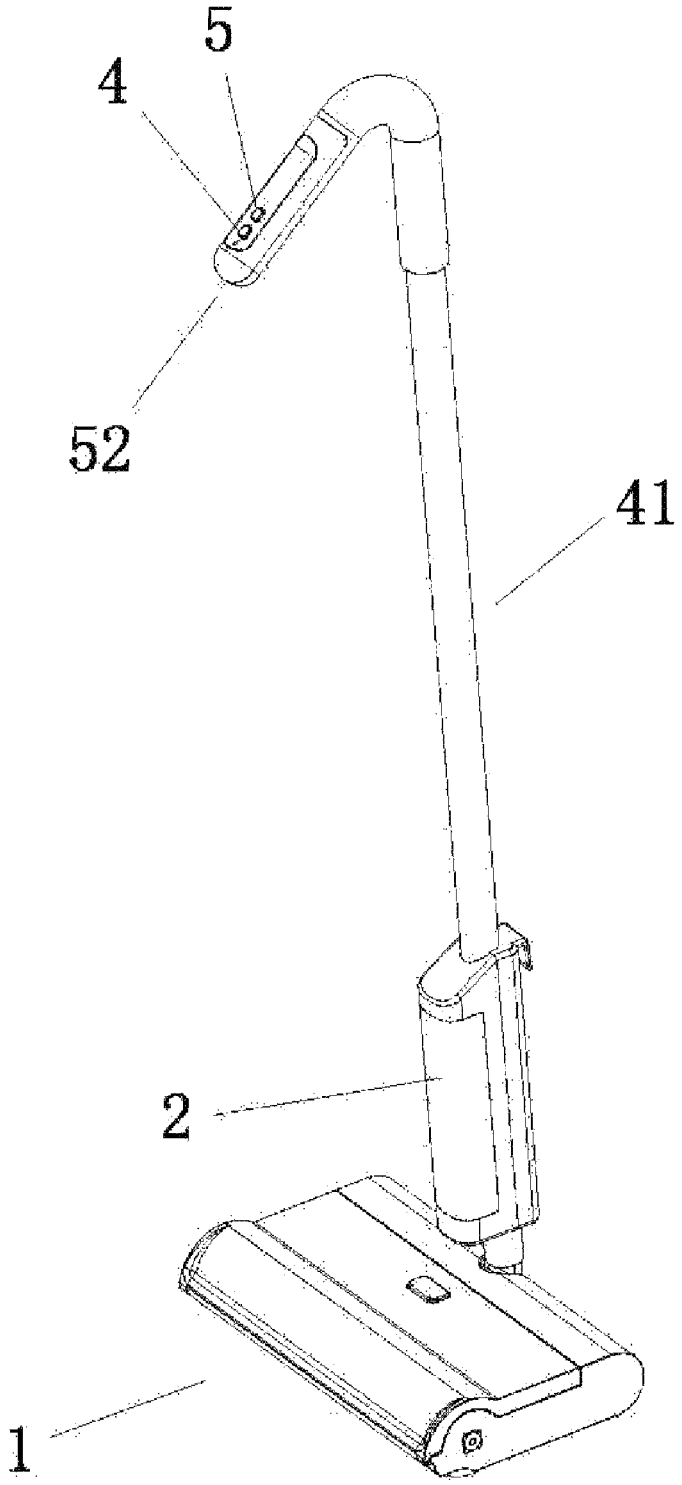
FIG. 1 is a stereoscopic view illustrating the front of the pull rod and the mop head component of the invention.

In order to make the objective, technical solutions and the advantageous of the invention more clear, the invention is further described in detail with reference to the accompany drawings hereinafter. It should be understood that the specific embodiments described herein are merely to illustrate the invention and are not intended to limit the invention.

The invention discloses a roller mop capable of self-cleaning, comprising a pull rod 41, a mop head component 1, and a cleaning basin capable of holding the mop head component 1. The pull rod is grasped by a person to operate; a motor in the mop head component drives a roller to clean the ground; after the mopping is ended, the mop head component can be put in the cleaning basin for charging and washing with water.

With reference to FIGS. 1, 2, 10, and 11, the pull rod is grasped by a person to operate, and is provided with a control circuit therein, and a battery 2, a power-on button 5, a self-cleaning button 4, a signal contact piece 8 and a charging contact piece 7 that are electrically connected to the control circuit; the outside of the pull rod is provided with a hook 6. The battery supplies power to the motor in the control circuit and the mop head component; the power-on button 5 controls the power on and power off to clean the ground; the self-cleaning button controls the mop head component to self-clean in the cleaning basin; the signal contact piece and the charging contact piece are used to electrically connect the pull rod to the cleaning basin.

The mop head component comprises a shell, and the rear end of the shell is hinged to the bottom of the pull rod; the inside of the shell is provided with a motor 15 controlled by the control circuit; the motor drives a roller 10 at the outside thereof; the lower part of the roller is exposed from the front of the shell, and is rotated counterclockwise under the drive of the motor to clean the ground by rolling friction. The position near the roller inside the shell is provided with a trash bin 17, and the trashes caught by the roller fall into the trash bin.

Figure 7:
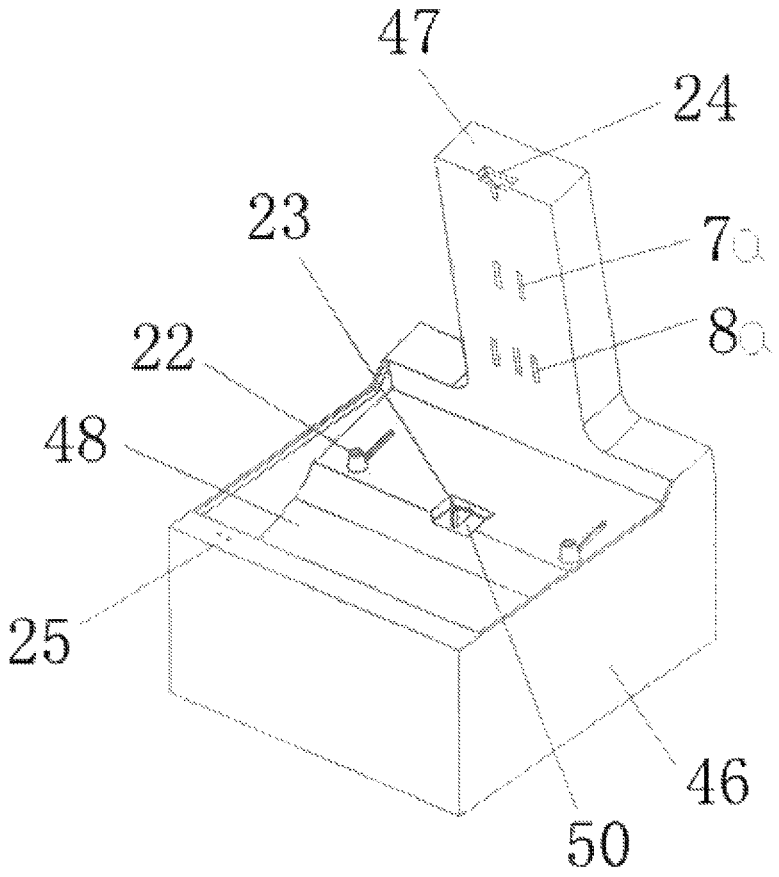
FIG. 7 is a stereoscopic view illustrating the front of the cleaning basin of the invention.
Figure 8:
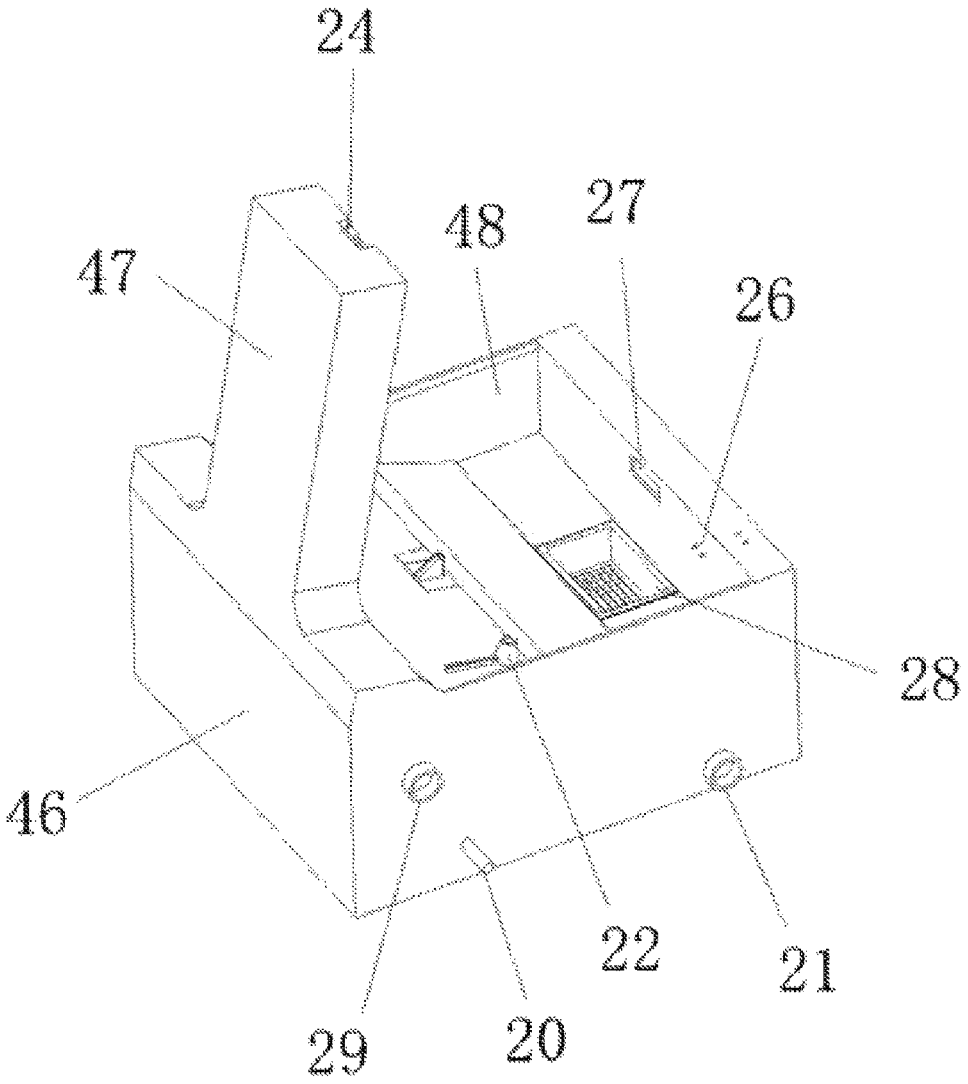
FIG. 8 is a stereoscopic view illustrating the rear of the cleaning basin of the invention.
Figure 9:
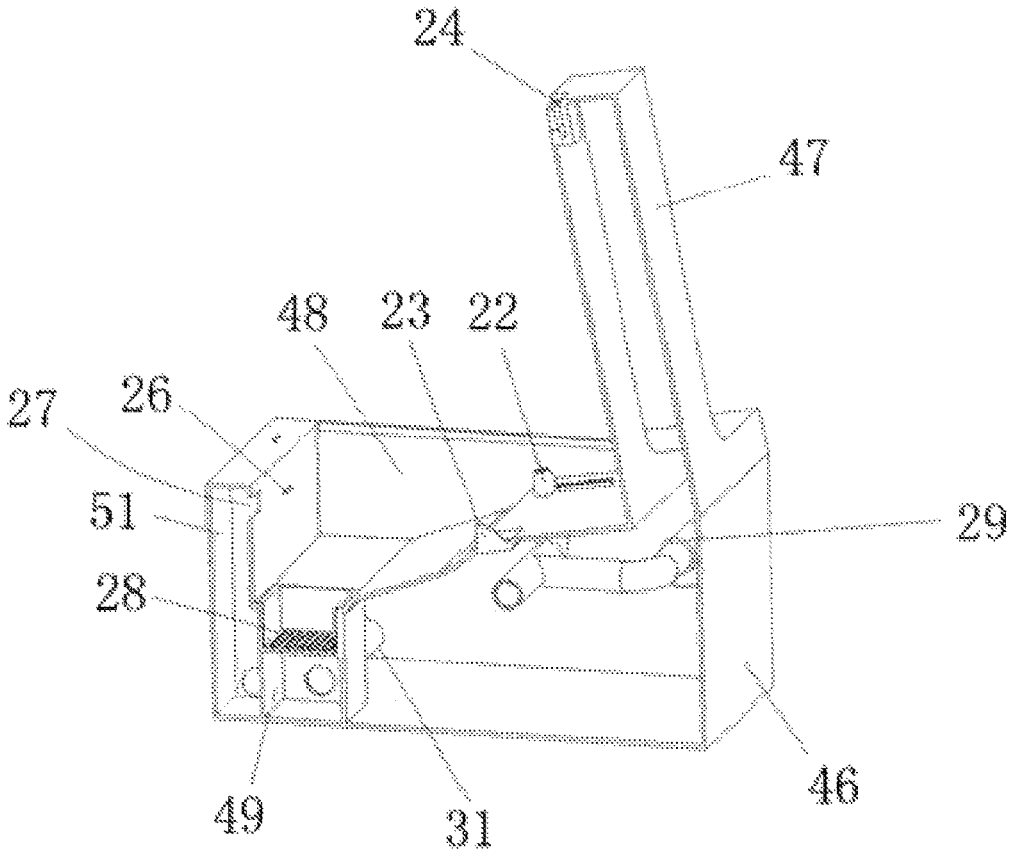
FIG. 9 is a sectional view illustrating the cleaning basin of the invention.
Figure 10:
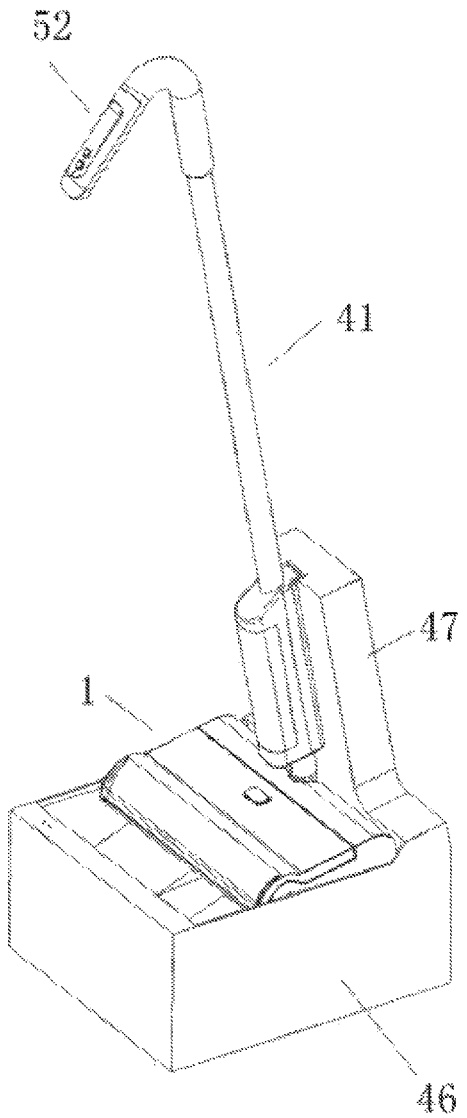
FIG. 10 is a stereoscopic view illustrating the front of the roller mop of the invention.
Figure 11:
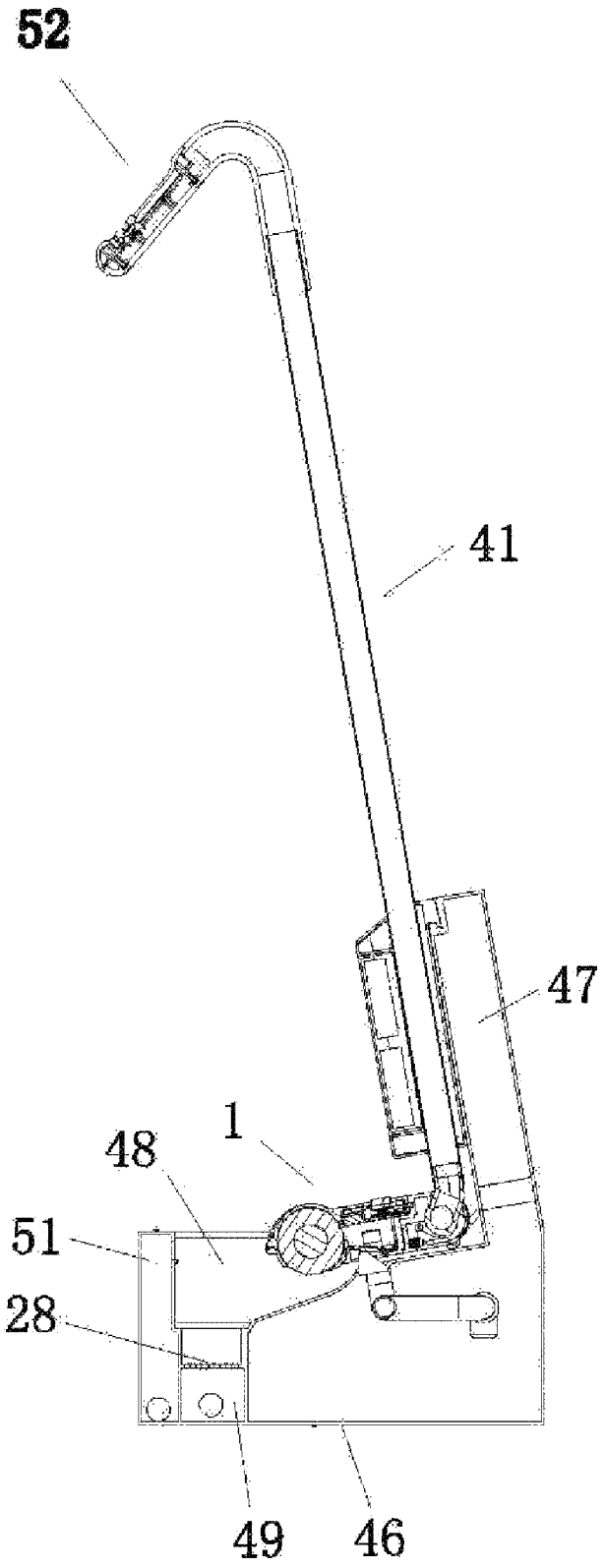
FIG. 11 is a stereoscopic view illustrating the rear of the roller mop of the invention.

With reference to FIGS. 7, 8, and 9, the cleaning basin comprises a basin body 46 and a support column 47 erected at one side of the basin body. The inside of the basin body is provided with a cleaning chamber 48 and an outlet chamber 49 stacked on top of each other; the cleaning chamber is open upward for holding the mop head component to be cleaned, and the cleaning chamber is connected to the external tap water through an inlet solenoid valve 29; the outlet chamber is connected to the external sewage pipe through a drain solenoid valve 31; between the cleaning chamber and the outlet chamber is provided with a netted trash bag 28, and the netted trash bag can carry the trashes and can be taken out and discarded after the cleaning process. The support column is used for supporting the pull rod, and the top thereof is provided with a socket 24 for inserting the hook 6 of the pull rod. The side wall of the support column is provided with a signal elastic piece 8*a* and a charging elastic piece 7*a*; the water level sensor, the inlet solenoid valve and the drain solenoid valve are connected to the control circuit through the signal contact piece and the signal elastic piece; after passing through the power adapter, the mains is connected to the control circuit through the charging contact piece and the charging elastic piece 7*a*. The hook is inserted into the socket, and the flushing pipe is inserted into the flushing sleeve so that the signal contact piece and the signal elastic piece, the signal elastic piece and the charging elastic piece 7*a* are crimped to each other, and a good electrical connection is achieved. The number 20 in FIG. 8 refers to a power line connected to the outside, and the power adapter can be installed inside the basin body of the washing basin or the outside thereof. With reference to the usage schematic diagram illustrated in FIGS. 10 and 11, the roller mop 41 is placed in the cleaning basin, the user presses the cleaning button, the control circuit controls the inlet solenoid valve 29 to open, then the drain solenoid valve 31 opens, and the roller mop is flushed with tap water; the roller needs to be corresponded to rotate during cleaning to clean up the roller.

With reference to the preferred embodiment illustrated in FIGS. 3, 4, 5, and 6, the shell comprises an upper cover 42 and a chassis 43 that can be fastened up and down; the rear end of the chassis is hinged to the bottom of the pull rod through a rotating rod 44, and the rear end of the chassis is provided with wheels 45. The roller and the wheels support the mop head component together to enable the chassis to be parallel to the ground, and the pull rod can be flexibly vertical and inclined to facilitate operation at various angles.

The front end of the trash bin 17 is installed with a scraping soft film 18 at the position close to the roller and the ground, and the a cleaning strip 14 for cleaning the surface of the roller is fixed at the middle of the upper cover; the bottom of the trash bin 17 is provided with an upward-open flap door 13 and at least one upward-protrude hollow flushing sleeve 11. The roller rotates counterclockwise to clean the ground, and the trashes on the ground are taken to the right; large trashes automatically fall into the trash bin, and small trashes are swept into the trash bin by the cleaning strip. The scraping soft film 18 scrapes off the residual dirt and moisture from the underside to further clean the ground. When the mop head component is placed in the cleaning basin for cleaning, clean water is injected into the flushing sleeve, then the flap door 13 is lashed to open, and the water can wash away the trashes in the trash bin.

Figure 5:
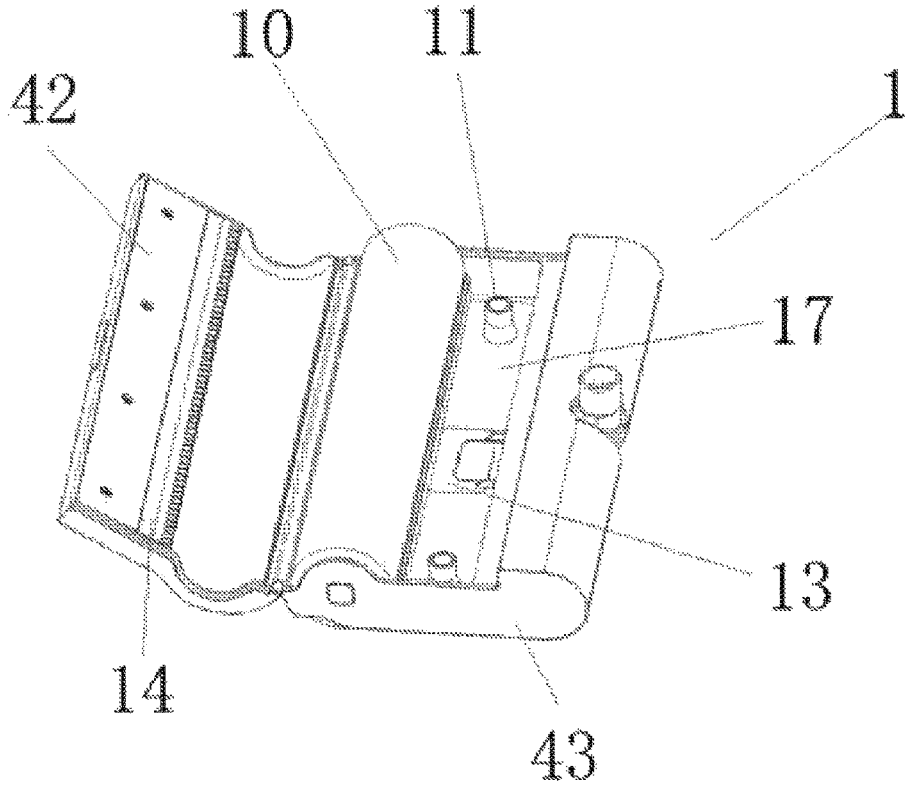
FIG. 5 is an expanded view illustrating the mop head component of the invention.
Figure 6:
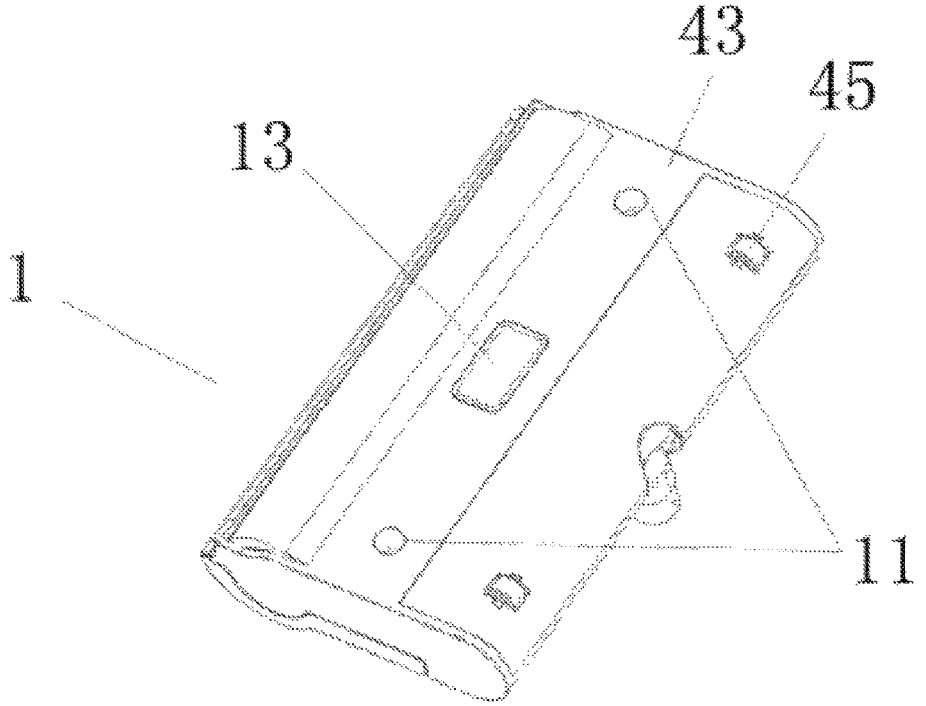
FIG. 6 is a stereoscopic view illustrating the bottom of the mop head component of the invention.

The front end of the upper cover 42 is hinged to the front end of the chassis 43, and the rear end of the upper cover is engaged with the middle of the chassis through a spring handle 9. FIG. 5 illustrates the status that the upper cover is open, and the cleaning strip 14 and the roller 10 can be replaced after the upper cover is opened. The number 16 in FIG. 4 refers to the roller removal button.

To facilitate sliding and operating the roller mop, the top end of the pull rod 41 is provided with a handle 52 bent in the direction of the mop head component, and the power-on button 5 and the self-cleaning button 4 are disposed on the handle.

Between the middle of the chassis 43 and the bottom end of the pull rod 41 is provided with a spring 53; the pull rod is moved by the spring to the top of the mop head component 1 when it is not subjected to an external force, so that the roller mop maintains an upright status; this structure keeps the balance of the roller mop so that it will not turn over. The pull rod 41 adopts the telescopic rod, which is convenient for adjusting the length of the pull rod.

The battery 2 adopts the elongated structure and is fastened to the outer side wall of the bottom of the pull rod to facilitate the battery replacement. The cleaning strip 14 adopts the brush or the soft rubber strip. It should be understood that the brush or soft rubber strip is not used to limit the type of the cleaning strip, as long as the material can sweep the trashes on the roller without damaging the roller. The roller adopts the polymer foam.

Figure 2:
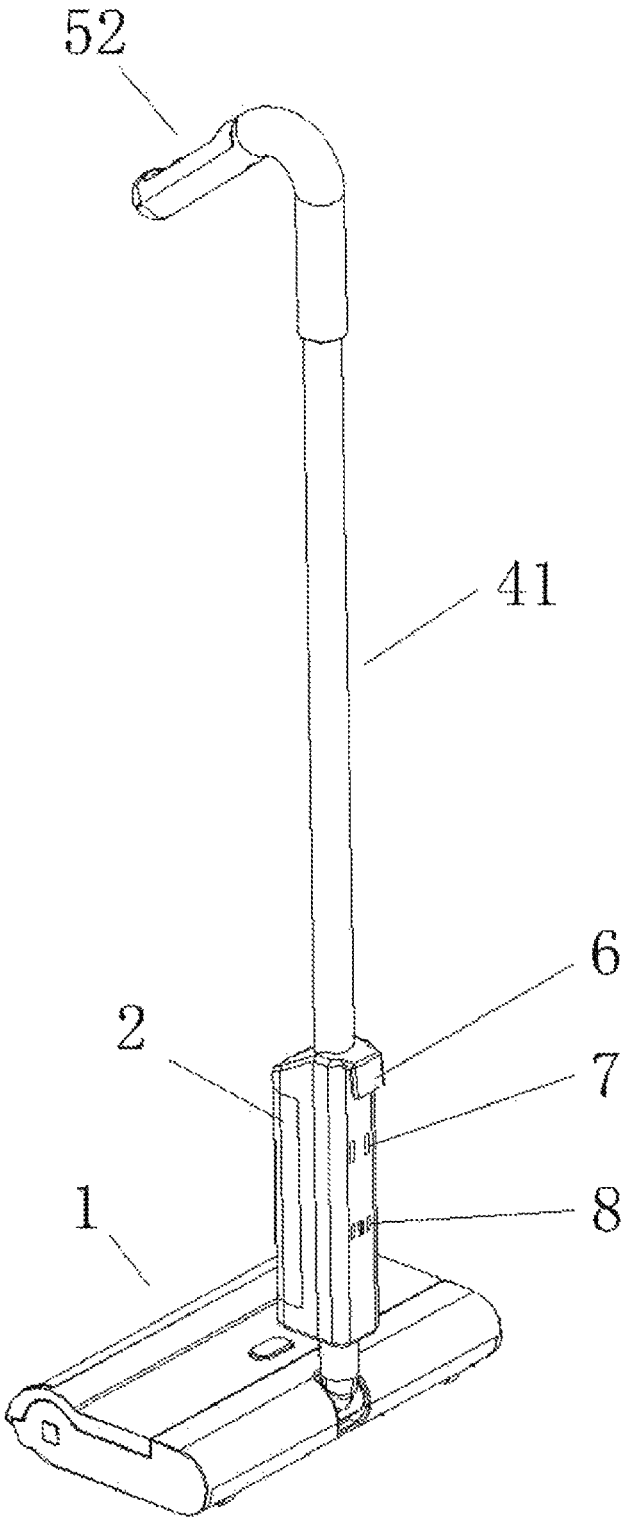
FIG. 2 is a stereoscopic view illustrating the rear of the pull rod and the mop head component of the invention.
Figure 3:
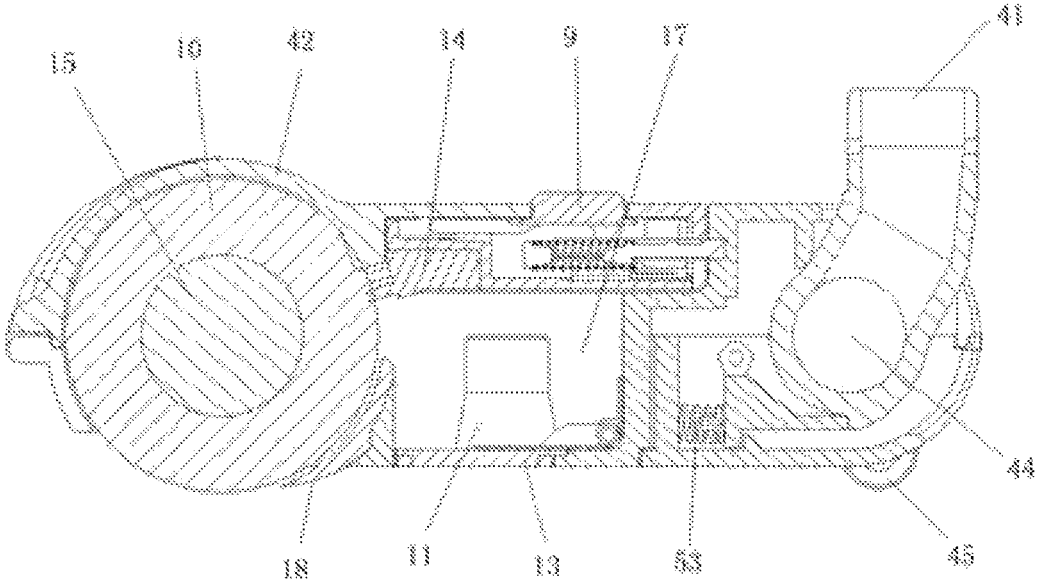
FIG. 3 is a sectional view illustrating the mop head component of the invention.
Figure 4:
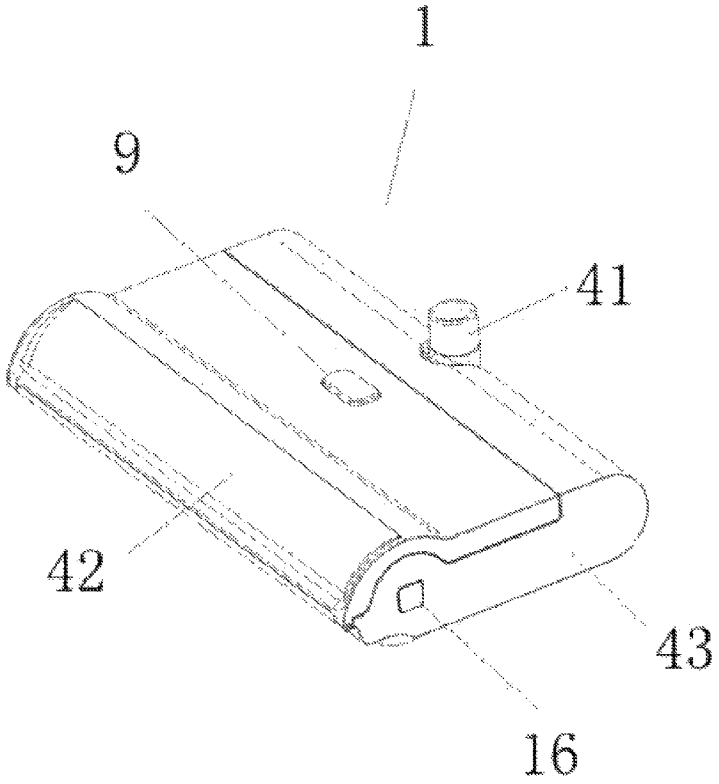
FIG. 4 is a stereoscopic view illustrating the front of the mop head component of the invention.

With reference to the preferred embodiment illustrated in FIGS. 7, 8, and 9, one side of the basin body 46 is provided with an overflow chamber 51; the side wall of the cleaning chamber 48 is provided with an overflow port 27 connecting the overflow chamber, and the overflow chamber is connected to the external sewage pipe. During the operation, the water level in the cleaning chamber can be limited to prevent water from escaping from the upper edge of the basin body. The outlet port of the inlet solenoid valve 29 can be connected to the overflow chamber, and the drain port 21 in FIG. 2 is used to connect the external sewage pipe.

One side of the bottom board of the cleaning chamber sinks downward, and the netted trash bag 28 is provided therein; the bottom board of the cleaning chamber is inclined downward toward the side of the netted trash bag 28; the middle of the bottom board is provided with a water-flowing groove 50, and a top piece 23 is erected in the water-flowing groove; at least one flushing pipe 22 that can be inserted into the flushing sleeve 11 is erected at the bottom of the cleaning chamber, and the inlet end of the flushing pipe is connected to the inlet solenoid valve 29. The structure is for lifting the roller mop, and the roller is immersed in the water as much as possible, and at the same time, there is a large slope difference between the roller and the netted trash bag 28, so that the trashes in the trash bin beside the roller and the roller can be washed out. The top piece 23 can lash the flap door of the bottom of the trash bin in the roller mop to open, and the flushing pipe penetrates into the inside of the roller mop to flush the roller and the trash bin to achieve deep cleaning effect. The water-flowing groove 50 can widen the passage of sewage discharge. In the preferred embodiment, there are two flushing pipes and flushing sleeves, and the flushing pipe is inserted into the flushing sleeve to deep flush the trash bin, which also achieve the function of positioning the mop head component in the trash bin.

The self-cleaning process is described below. 1. The mop head component is inserted into the cleaning basin, and the signal contact piece is in contact with the signal elastic piece, the signal elastic piece is in contact with the charging elastic piece, then the flap door 13 is lashed to open by the top piece 23, and the indicator light on the basin body is lighted up. 2. The user presses the self-cleaning button 4, and the drain solenoid valve is closed, the inlet solenoid valve is opened, then the tap water enters into the cleaning basin and is poured into the trash bin. 3. The flap door is in an open status, the trashes flow out with the water, and the sewage flows into the outlet chamber at the bottom. 4. When the water level reaches the sensor, the inlet solenoid valve is closed, the roller rotates counterclockwise, and a large amount of water is transferred to the trash bin, which again serves to clean the trash bin, and also cleans the roller and the cleaning strip. 5. After the inlet solenoid valve is closed for 2 minutes, the drain solenoid valve opens and the sewage drains through the hose to the bottom passage (the roller is still rotating). 6. One minute after the drain solenoid valve is opened, the roller stops rotating and the roller mop automatically enters the charging mode. 7. The charging indicator light on the cleaning basin (as illustrated by the number 25 in FIG. 7) is lighted up.

The above embodiments are merely to illustrate the invention, and are not to limit the invention. Any equivalent modifications or variations without departing from the spirit and protection scope of the invention shall all fall within the protection scope of the appended claims of the invention.

The invention claimed is:

1. A roller mop capable of self-cleaning, comprising a pull rod, wherein the pull rod is configured to be grasped by a person to operate, wherein the pull rod comprises a control circuit therein, and wherein an outside of the pull rod comprises a hook;

a mop head component comprising a shell, wherein a rear end of the shell is hinged to a bottom of the pull rod, wherein the inside of the shell comprises a motor controlled by the control circuit, wherein the motor drives a roller, wherein the lower part of the roller is exposed from the front of the shell to clean a ground, and wherein a trash bin is provided inside the shell;

a cleaning basin coupled to the mop head component, wherein the cleaning basin comprises a basin body, wherein an inside of the basin body comprises a cleaning chamber and an outlet chamber positioned under the cleaning chamber, wherein the cleaning chamber is configured to open upward for holding the mop head component to be cleaned, wherein the cleaning chamber is configured to connect to external tap water through an inlet solenoid valve, wherein the outlet chamber is configured to connect to an external sewage pipe through a drain solenoid valve, wherein a netted trash bag is arranged between the cleaning chamber and the outlet chamber, wherein a support column for supporting the pull rod is erected at one side of the basin body, wherein the support column comprises a socket, a signal elastic piece, and a charging elastic piece, wherein the socket is used for inserting the hook of the pull rod, wherein the inlet solenoid valve and the drain solenoid valve are coupled to the control circuit through the signal contact piece and the signal elastic piece, wherein after passing through a power adapter, a mains is coupled to the control circuit through the charging contact piece and the charging elastic piece;

a battery electrically coupled to the control circuit;

a power-on button electrically coupled to the control circuit;

a self-cleaning button electrically coupled to the control circuit;

a signal contact piece electrically coupled to the control circuit; and a charging contact piece electrically coupled to the control circuit.

2. The roller mop capable of self-cleaning according to claim 1, wherein the shell comprises an upper cover and a chassis, wherein a rear end of the chassis is hinged to the bottom of the pull rod through a rotating rod, and wherein the rear end of the chassis comprises wheels.

3. The roller mop capable of self-cleaning according to claim 2, wherein a front end of the trash bin is installed with a scraping soft film, wherein a cleaning strip for cleaning a surface of the roller is fixed at a middle of the upper cover, and wherein a bottom of the trash bin comprises an upward-open flap door and at least one upward-protrude hollow flushing sleeve.

4. The roller mop capable of self-cleaning according to claim 3, wherein a front end of the upper cover is hinged to a front end of the chassis, and wherein a rear end of the upper cover is engaged with a middle of the chassis through a spring handle.

5. The roller mop capable of self-cleaning according to claim 4, wherein a top end of the pull rod comprises a handle bent in the direction of the mop head component, and wherein the power-on button and the self-cleaning button are disposed on the handle.

6. The roller mop capable of self-cleaning according to claim 5, further comprising a spring positioned between the middle of the chassis and a bottom end of the pull rod, wherein the pull rod is driven by the spring to move to an upper portion of the mop head component when the pull rod is not subjected to an external force, so that the roller mop maintains an upright status, and wherein the pull rod is a telescopic rod.

7. The roller mop capable of self-cleaning according to claim 6, wherein the battery has an elongated structure and is fastened to an outer side wall of the bottom of the pull rod, wherein the cleaning strip comprises a brush or a soft rubber strip, and wherein the roller comprises a polymer foam.

8. The roller mop capable of self-cleaning according to claim 7, further comprising a water level sensor coupled to the control circuit and arranged on a side wall of the cleaning chamber, wherein the control circuit will close the inlet solenoid valve when the water level sensor senses that the water is in place.

9. The roller mop capable of self-cleaning according to claim 8, further comprising:

an overflow chamber positioned on one side of the basin body, wherein the overflow chamber is configured to connect to the external sewage pipe; and an overflow port connecting the overflow chamber to the cleaning chamber and formed on the side wall of the cleaning chamber.

10. The roller mop capable of self-cleaning according to claim 9, wherein one side of a bottom board of the cleaning chamber is angled downward, wherein the netted trash bag is provided in the cleaning chamber, wherein the bottom board of the cleaning chamber is inclined downward toward a side of the netted trash bag, wherein a middle of the bottom board comprises a water-flowing groove oriented towards a garbage net, wherein a top piece is erected in the water-flowing groove, wherein at least one flushing pipe that can be inserted into the flushing sleeve is erected at a bottom of the cleaning chamber, and wherein the inlet end of the flushing pipe is coupled to the inlet solenoid valve.

11. A roller mop, comprising:

a rod comprising a control circuit therein;

a mop head component comprising a shell, wherein a rear end of the shell is hinged to a bottom of the rod, wherein the inside of the shell comprises a motor controlled by the control circuit, wherein the motor drives a roller, wherein at least part of the roller is exposed from the front of the shell, and wherein a trash bin is provided inside the shell;

a cleaning basin coupled to the mop head component, wherein the cleaning basin comprises a basin body, wherein an inside of the basin body comprises a cleaning chamber and an outlet chamber positioned under the cleaning chamber, wherein the cleaning chamber is configured to open upward and comprises an inlet solenoid valve, wherein the outlet chamber comprises a drain solenoid valve, wherein a trash bag is arranged between the cleaning chamber and the outlet chamber, wherein a support column is positioned at one side of the basin body, wherein the support column comprises a socket, a signal elastic piece, and a charging elastic piece, wherein the socket is configured to receive the rod, wherein the inlet solenoid valve and the drain solenoid valve are coupled to the control circuit through the signal contact piece and the signal elastic piece, wherein after passing through a power adapter, a mains is coupled to the control circuit through the charging contact piece and the charging elastic piece;

a battery electrically coupled to the control circuit;

a power-on button electrically coupled to the control circuit;

a self-cleaning button electrically coupled to the control circuit;

a signal contact piece electrically coupled to the control circuit; and a charging contact piece electrically coupled to the control circuit.

12. The roller mop according to claim 11, wherein the shell comprises an upper cover and a chassis, wherein the chassis is hinged to the rod through a rotating rod, and wherein the chassis comprises wheels.

13. The roller mop according to claim 11, wherein the trash bin comprises a scraping soft film, wherein a cleaning strip is positioned on the upper cover, and wherein the trash bin comprises a flap door and a hollow flushing sleeve.

14. The roller mop according to claim 11, wherein the upper cover is hinged to the chassis, and wherein the upper cover is coupled to the chassis through a spring handle.

15. The roller mop according to claim 11, wherein the rod comprises a handle, and wherein the power-on button and the self-cleaning button are disposed on the handle.

16. The roller mop according to claim 11, further comprising a spring positioned between the chassis and the rod, wherein the rod is driven by the spring to move to the mop head component when the rod is not subjected to an external force, so that the roller mop maintains an upright status, and wherein the rod is a telescopic rod.

17. The roller mop according to claim 11, wherein the battery has an elongated structure and is fastened to the rod, wherein the cleaning strip comprises a brush or a rubber strip, and wherein the roller comprises a polymer foam.

18. The roller mop according to claim 11, further comprising a water level sensor coupled to the control circuit and arranged on the cleaning chamber, wherein the control circuit is configured to close the inlet solenoid valve when the water level sensor senses that the water is in place.

19. The roller mop according to claim 11, further comprising:

an overflow chamber positioned on the basin body; and an overflow port connecting the overflow chamber to the cleaning chamber and formed on the cleaning chamber.

20. The roller mop according to claim 11, wherein one side of the cleaning chamber is angled downward, wherein the trash bag is provided in the cleaning chamber, wherein a bottom board of the cleaning chamber is inclined downward toward the trash bag, wherein a middle of the bottom board comprises a water-flowing groove, wherein a top piece is erected in the water-flowing groove, wherein at least one flushing pipe that can be inserted into the flushing sleeve is positioned at a bottom of the cleaning chamber, and wherein the inlet end of the flushing pipe is coupled to the inlet solenoid valve.

* * * * *